US008009113B2

(12) United States Patent
Sanford

(10) Patent No.: US 8,009,113 B2
(45) Date of Patent: Aug. 30, 2011

(54) SYSTEM AND METHOD FOR FOCUSING ANTENNA SIGNAL TRANSMISSION

(75) Inventor: John Sanford, Encinitas, CA (US)

(73) Assignee: Cushcraft Corporation, Manchester, NH (US)

( * ) Notice: Subject to any disclaimer, the term of this patent is extended or adjusted under 35 U.S.C. 154(b) by 1076 days.

(21) Appl. No.: 11/627,044

(22) Filed: Jan. 25, 2007

(65) Prior Publication Data

US 2008/0180335 A1 Jul. 31, 2008

(51) Int. Cl.
*H01Q 19/06* (2006.01)

(52) U.S. Cl. ..... 343/753; 343/700 MS; 343/756

(58) Field of Classification Search ..... 343/753, 343/754, 756, 757, 783, 872, 909, 911, 700 MS, 343/781, 786, 852, 773, 825, 911 R
See application file for complete search history.

(56) References Cited

U.S. PATENT DOCUMENTS

| | | | | | |
|---|---|---|---|---|---|
| 2,736,894 | A * | 2/1956 | Kock | 343/753 |
| 3,331,721 | A * | 7/1967 | Horst | 156/250 |
| 3,392,396 | A * | 7/1968 | Ehrenspeck | 343/755 |
| 3,964,070 | A * | 6/1976 | Drabowitch | 343/786 |
| 4,246,584 | A * | 1/1981 | Noerpel | 343/786 |
| 4,321,604 | A * | 3/1982 | Ajioka | 343/753 |
| 4,568,943 | A * | 2/1986 | Bowman | 343/756 |
| 4,783,665 | A * | 11/1988 | Lier et al. | 343/786 |
| 5,121,129 | A * | 6/1992 | Lee et al. | 343/753 |
| 5,420,597 | A * | 5/1995 | Duncan | 343/703 |
| 5,978,157 | A * | 11/1999 | Matthews | 359/737 |
| 6,014,105 | A | 1/2000 | Davis et al. | |
| 6,081,239 | A | 6/2000 | Sabet et al. | |
| 6,169,910 | B1 * | 1/2001 | Tamil et al. | 455/562.1 |
| 6,281,853 | B1 * | 8/2001 | Caille et al. | 343/754 |
| 6,404,397 | B1 * | 6/2002 | Grinberg et al. | 343/753 |
| 6,480,164 | B2 | 11/2002 | Posner et al. | |
| 6,538,615 | B1 * | 3/2003 | Schantz | 343/786 |
| 6,611,238 | B1 * | 8/2003 | Santoru et al. | 343/840 |
| 6,891,513 | B2 * | 5/2005 | Kienzle et al. | 343/786 |
| 6,894,652 | B2 * | 5/2005 | Rawnick et al. | 343/753 |
| 6,992,639 | B1 * | 1/2006 | Lier | 343/786 |
| 7,190,324 | B2 * | 3/2007 | Henderson | 343/909 |
| 7,525,501 | B2 * | 4/2009 | Black et al. | 343/773 |
| 7,656,345 | B2 * | 2/2010 | Paschen et al. | 342/75 |
| 2004/0070540 | A1 | 4/2004 | Wang et al. | |

* cited by examiner

*Primary Examiner* — Douglas W Owens
*Assistant Examiner* — Chuc Tran
(74) *Attorney, Agent, or Firm* — Harness, Dickey & Pierce, P.L.C.

(57) ABSTRACT

The system contains an antenna feed. A signal is in communication with the antenna feed. The signal has a wavelength and a period. A signal lens has a periphery portion that is thicker than an interior portion, wherein the signal propagates through the signal lens. The signal lens is designed such that the signal propagates through the periphery portion of the signal lens approximately one wavelength slower than through the interior portion of the signal lens.

25 Claims, 7 Drawing Sheets

SYSTEM AND METHOD FOR FOCUSING ANTENNA SIGNAL TRANSMISSION

FIELD OF THE INVENTION

The present invention is generally related to antennas, and more particularly is related to a system and method for focusing antenna signal transmission.

BACKGROUND OF THE INVENTION

Occasionally, basic radiating structures are integrated into a radio housing. These structures, such as dipoles, patch and horn antennas are generally low gain devices. Structures, such as reflectors or lenses, can be used to augment the low gain and produce a more directive beam. However, lenses can be too expensive and too heavy for many antenna applications. Preferably, a device would be able to augment the low gain without the weight of a microwave lens. The reduced material usage results in a more cost effective product.

The design does not employ traditional lens theory or the techniques used in zoned lenses. It is most applicable to lenses with directivities in the range of 12-25 dB. The resulting structures have focusing performance similar to a lens shaped like a common magnifying glass but with much less total material usage.

Thus, a heretofore unaddressed need exists in the industry to address the aforementioned deficiencies and inadequacies.

SUMMARY OF THE INVENTION

Embodiments of the present invention provide a system and method for focusing antenna signal transmission. Briefly described, in architecture, one embodiment of the system, among others, can be implemented as follows. The system contains an antenna feed. A signal is in communication with the antenna feed. The signal has a wavelength and a period. A signal lens has a periphery portion that is thicker than an interior portion, wherein the signal lens is impinged by the signal.

The present invention can also be viewed as providing methods for focusing antenna signal transmission. In this regard, one embodiment of such a method, among others, can be broadly summarized by the following steps: transmitting a signal from the antenna feed; transmitting the signal through an interior portion of a signal lens; and transmitting the signal through a periphery portion of the signal lens, wherein the signal is transmitted through the periphery portion slower than the interior portion.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
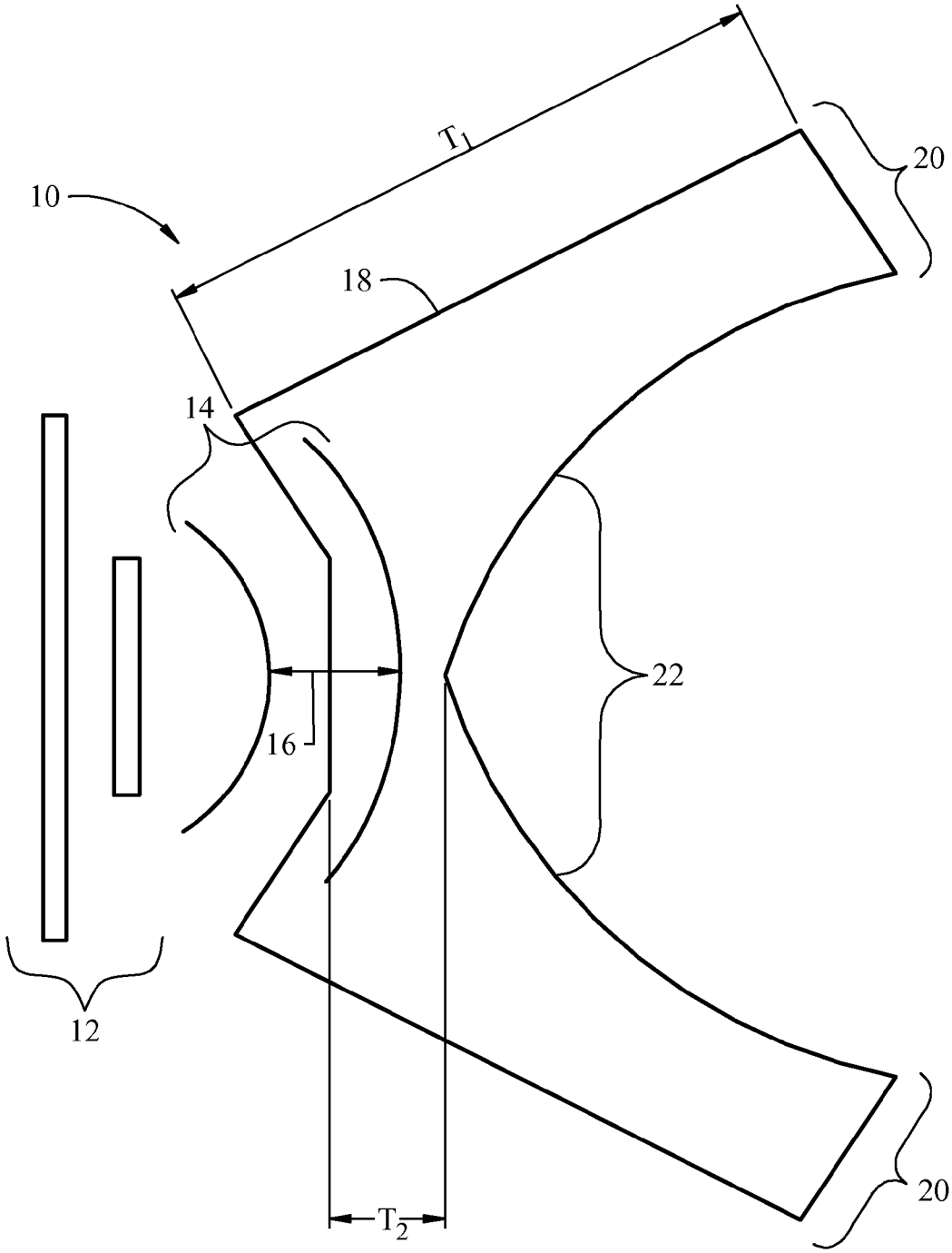
FIG. 1 is a cross-sectional side view of an antenna system, in accordance with a first exemplary embodiment of the present invention.
Figure 2:
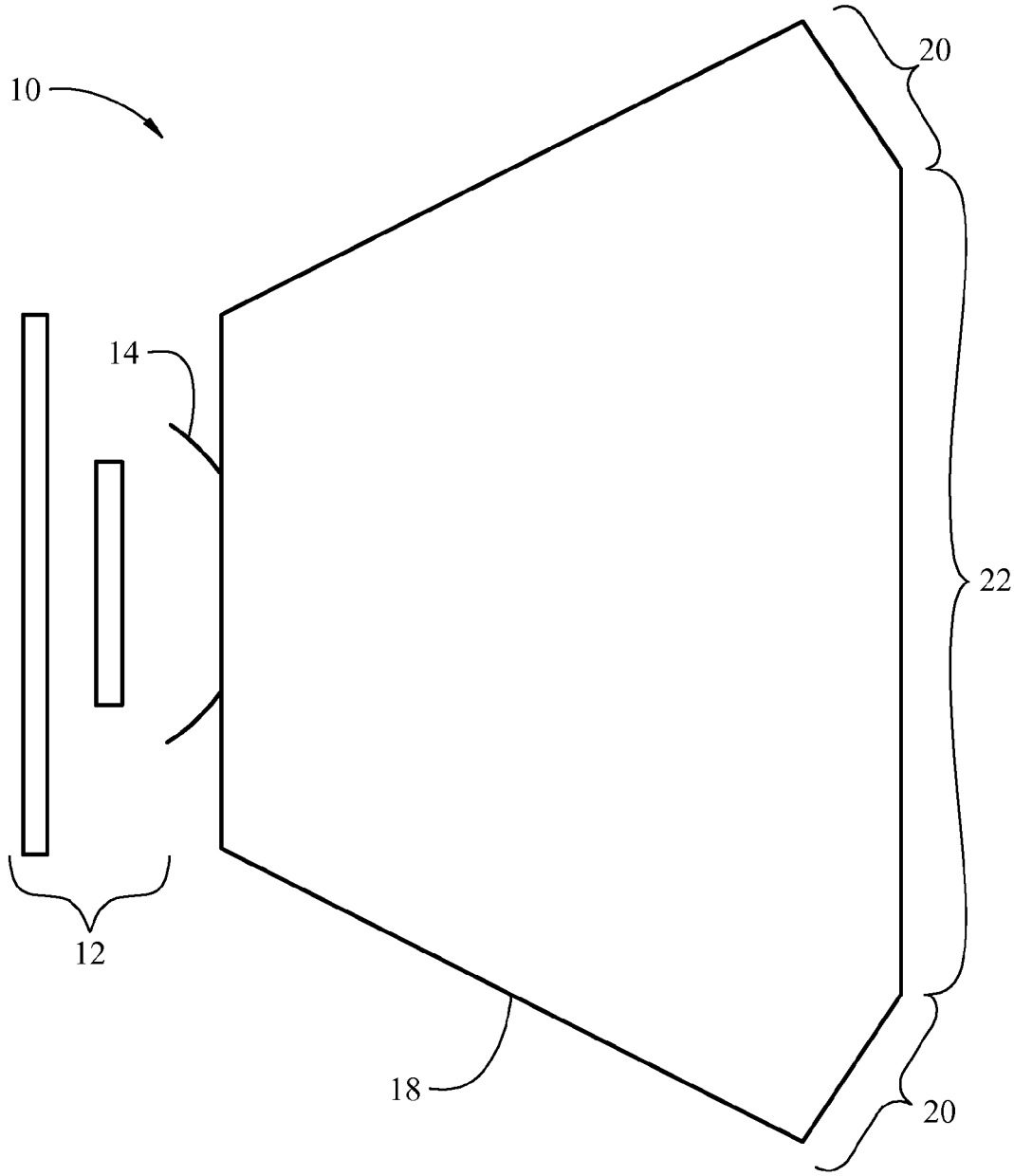
FIG. 2 is a side view of the antenna system, in accordance with the first exemplary embodiment of the present invention.

FIG. 1 is a cross-sectional side view of an antenna system 10, in accordance with a first exemplary embodiment of the present invention. FIG. 2 is a side view of the antenna system 10, in accordance with the first exemplary embodiment of the present invention. The antenna system 10 contains an antenna feed 12. A signal 14 is in communication with the antenna feed 12. The signal 14 has a wavelength 16 and a period. A signal lens 18 has a periphery portion 20 that is thicker (T1 is greater than T2 as shown in FIG. 1) than an interior portion 22, wherein the signal 14 at least partially propagates through the signal lens 18.

The signal lens 18 will be of a material that allows the signal to propagate therethrough. The signal 14 will propagate through the signal lens 18 slower than it propagates through air, or which ever medium in which the signal lens 18 is immersed. The arrangement of the signal lens 18 is designed to cause a portion of the signal 14 propagating through the periphery portion 20 of the signal lens to lag a portion of the signal 14 propagating through the interior portion 22. Specifically, as the periphery portion 20 is thicker (T1 is greater than T2 as shown in FIG. 1) than the interior portion 22, the portion of the signal 14 propagating through the periphery portion 20 will still be propagating through the signal lens 18 when the portion of the signal 14 propagating through the interior portion 22 has exited the signal lens 18.

The antenna feed 12 can be any feed known to those having ordinary skill in the art. For the purpose of further focusing transmissions and otherwise conserving energy, the antenna feed 12 may be designed to focus its signal 14 transmissions toward the signal lens 18, although the antenna feed need not provide any type of directionality for the invention to be operative.

Figure 3:
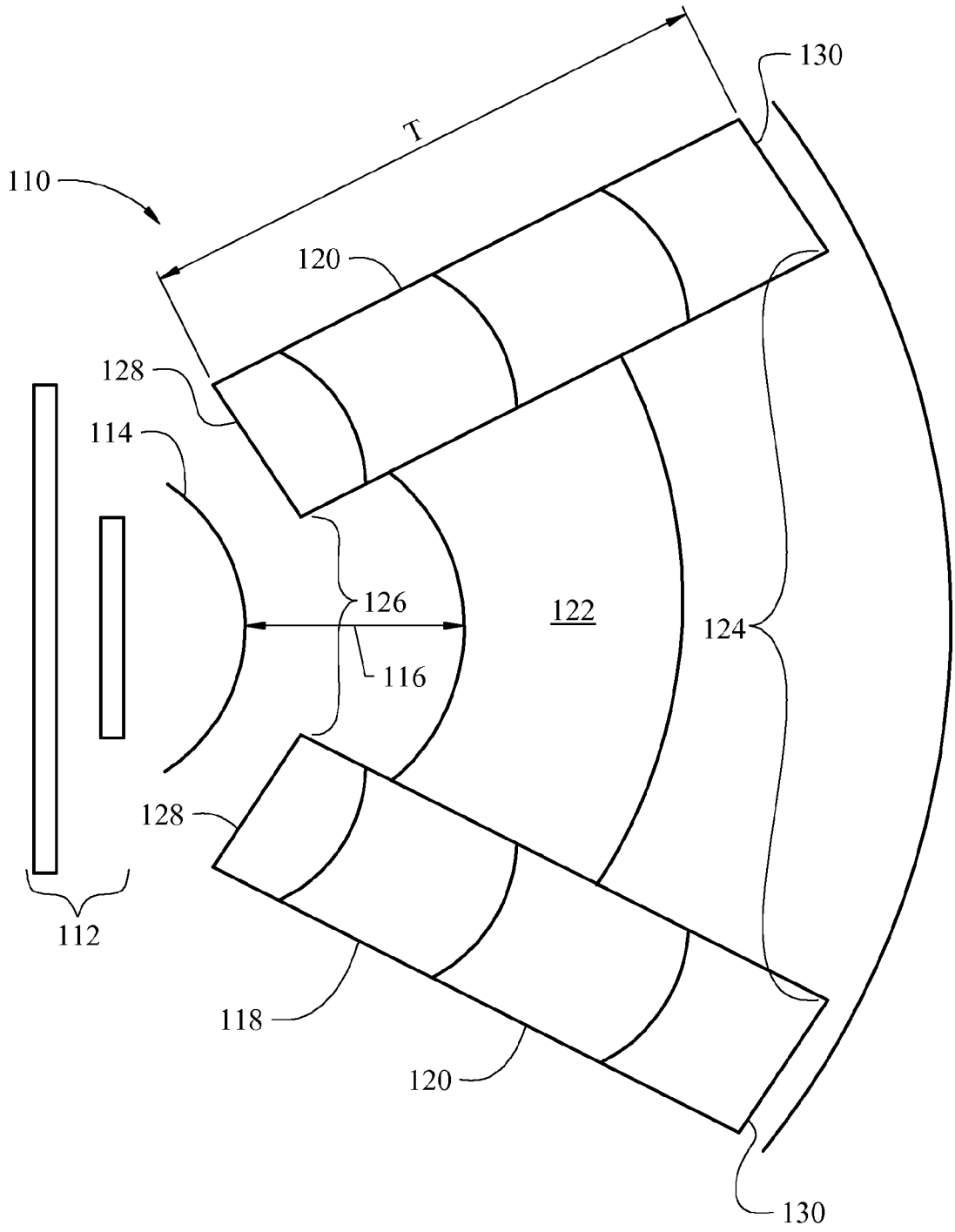
FIG. 3 is a cross-sectional side view of an antenna system, in accordance with a second exemplary embodiment of the present invention.

FIG. 3 is a cross-sectional side view of an antenna system 110, in accordance with a second exemplary embodiment of the present invention. The antenna system 110 contains an antenna feed 112. A signal 114 is in communication with the antenna feed 112. The signal 114 has a wavelength 116 and a period. A signal lens 118 has a periphery portion 120 and an aperture formed through an interior portion 122, wherein the signal lens 118 is impinged by the signal 114.

The signal lens 118 will be of a material that allows the signal to propagate therethrough. The signal 114 will propagate through the signal lens 118 slower than it propagates through air, or which ever medium in which the signal lens 118 is immersed. The arrangement of the signal lens 118 is designed to cause a portion of the signal 114 propagating through the periphery portion 120 of the signal lens to lag a portion of the signal 114 propagating through the aperture in the interior portion 122. Specifically, the portion of the signal 114 propagating through the periphery portion 120 will still be propagating through the signal lens 118 when the portion of the signal 114 propagating through the interior portion 122 has exited a distal opening 124 of the signal lens 118.

More specifically, the portion of the signal 114 propagating through the periphery portion 120 may be made to traverse the periphery portion 120 with approximately one wavelength than the portion of the signal 114 propagating through the interior portion 122 traverses the interior portion 122. Worded differently, a signal 114 reaching a proximate opening 126 of the signal lens and a proximate end 128 of the periphery portion may have the portion of the signal 114 propagating through the periphery portion 120 reach a distal end 130 of the periphery portion 120 approximately one wavelength behind the portion of the signal 114 propagating through the interior portion 122 reaches the distal opening 124. Similarly, after passing the signal lens 118, the portion of the signal 114 propagating through the periphery portion 120 may be a multiple of approximately one wavelength behind the portion of the signal 114 propagating through the interior portion 122.

As shown in FIG. 3, the distal opening 124 is larger than the proximate opening 126. A diameter of the distal opening 124 may be approximately three times a wavelength of the signal 114 or less, which has been shown in testing to provide positive results. A radial width W of the periphery portion 120 may be expressed approximately as $\lambda/(2n)$ and the thickness T of the periphery portion 120 may be expressed approximately as $\lambda/(n-1)$; where n is the dielectric constant of the lens material. For low loss materials it is approximately the square root the lenses' dielectric constant. These signal lens 118 dimensions, for a signal lens 118 made of a dielectric material, allow the portion of the signal 114 propagating through the periphery portion 120 to lag the portion of the signal 114 propagating through the interior portion 122 by a wavelength. The portion of the signal 114 propagating through the periphery portion 120 may then combine in phase with a subsequent cycle of a portion of the signal 114 propagating through the interior portion 122.

The signal lens 118, in the second exemplary embodiment, is shown to have a conical shape. Other shapes of the signal lens 118, such as a toroidal shape are conceivable for obtaining results similar to that of the present invention as described herein, and such signal lens 118 shapes are considered to be within the scope of the present invention.

Figure 4:
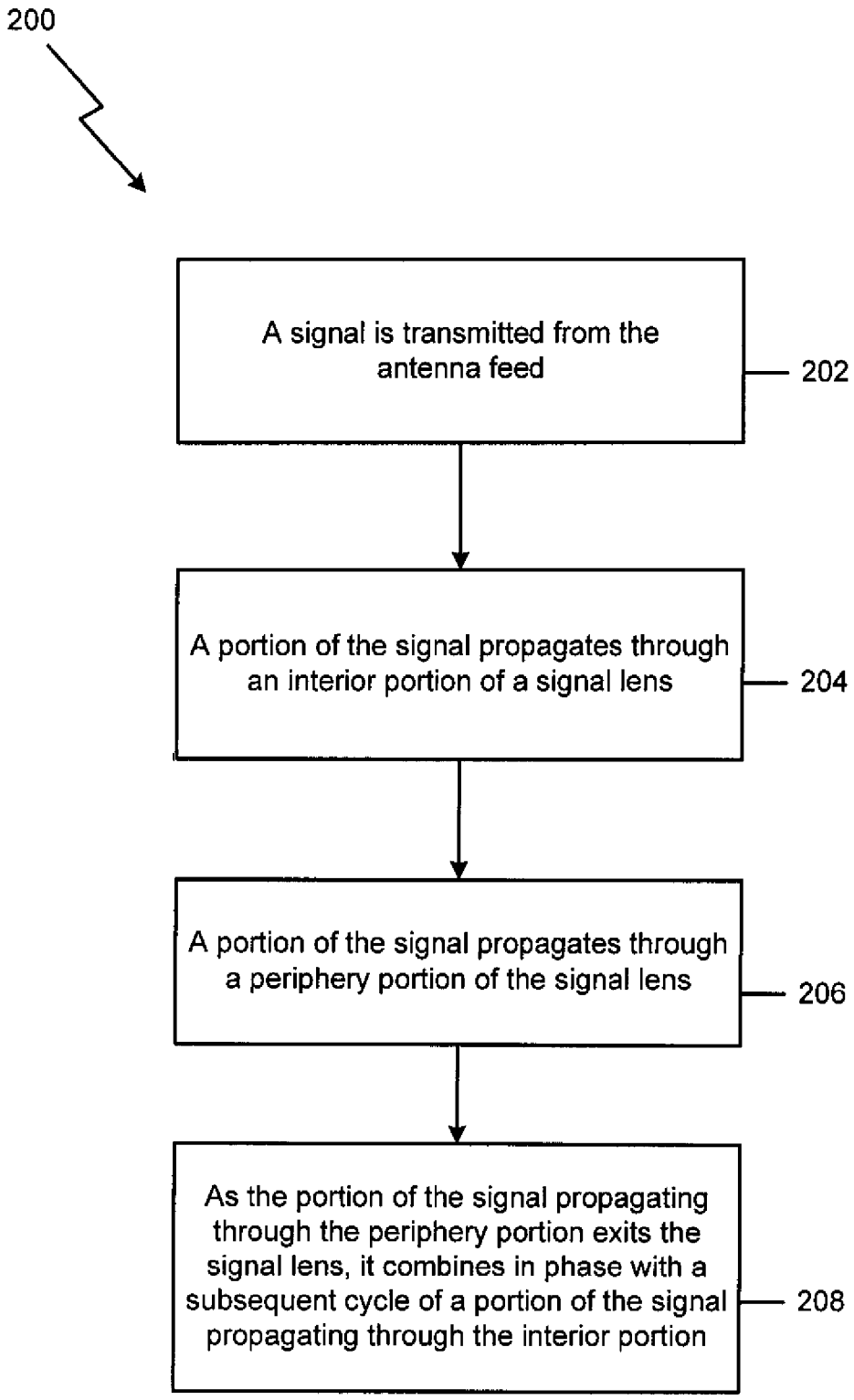
FIG. 4 is a flowchart illustrating a method for focusing antenna signal transmissions.
Figure 5:
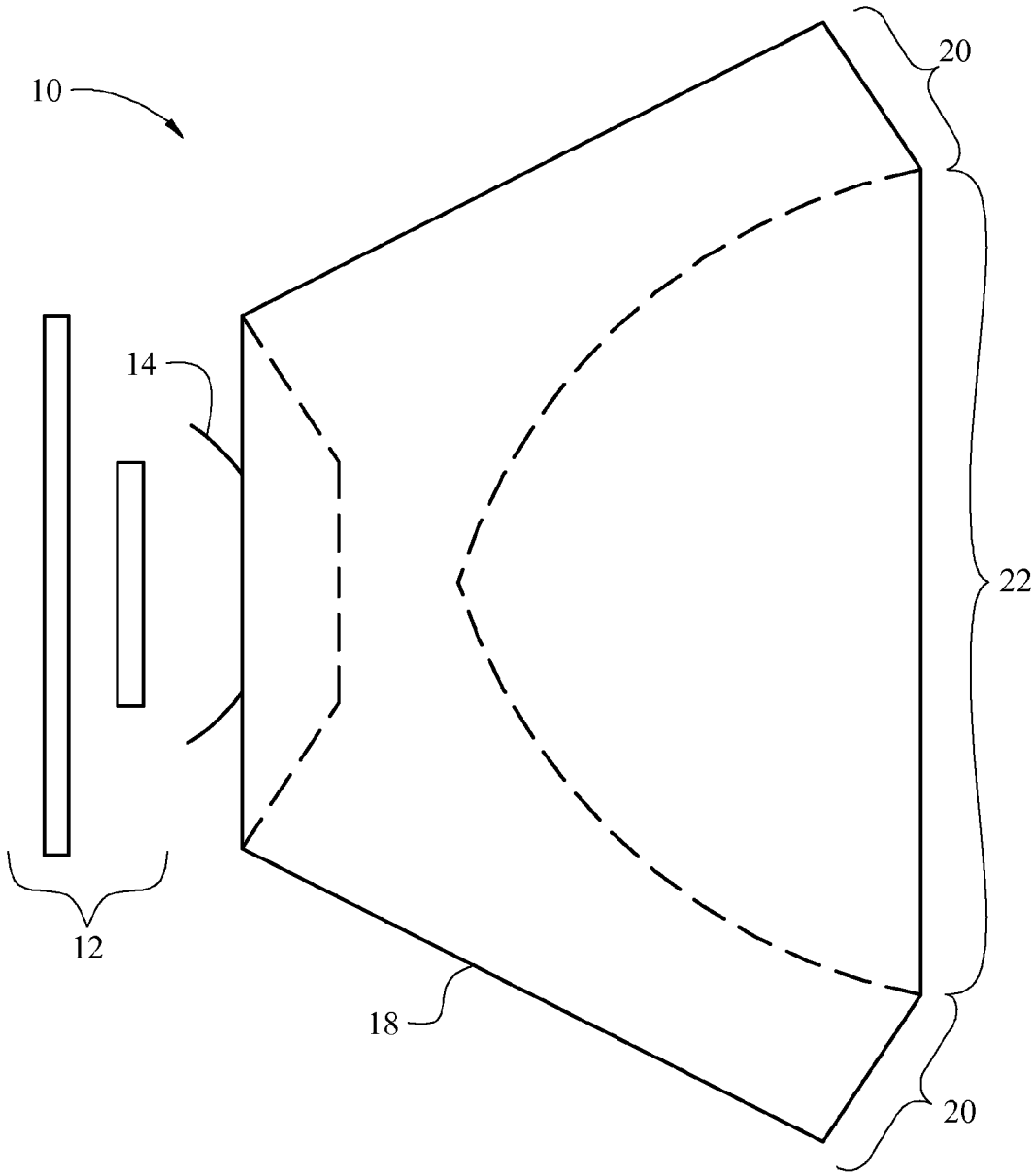
FIG. 5 is a side view of the antenna system shown in FIGS. 1 and 2, in accordance with the first exemplary embodiment, and also illustrating the interior of the lens in broken lines.
Figure 6:
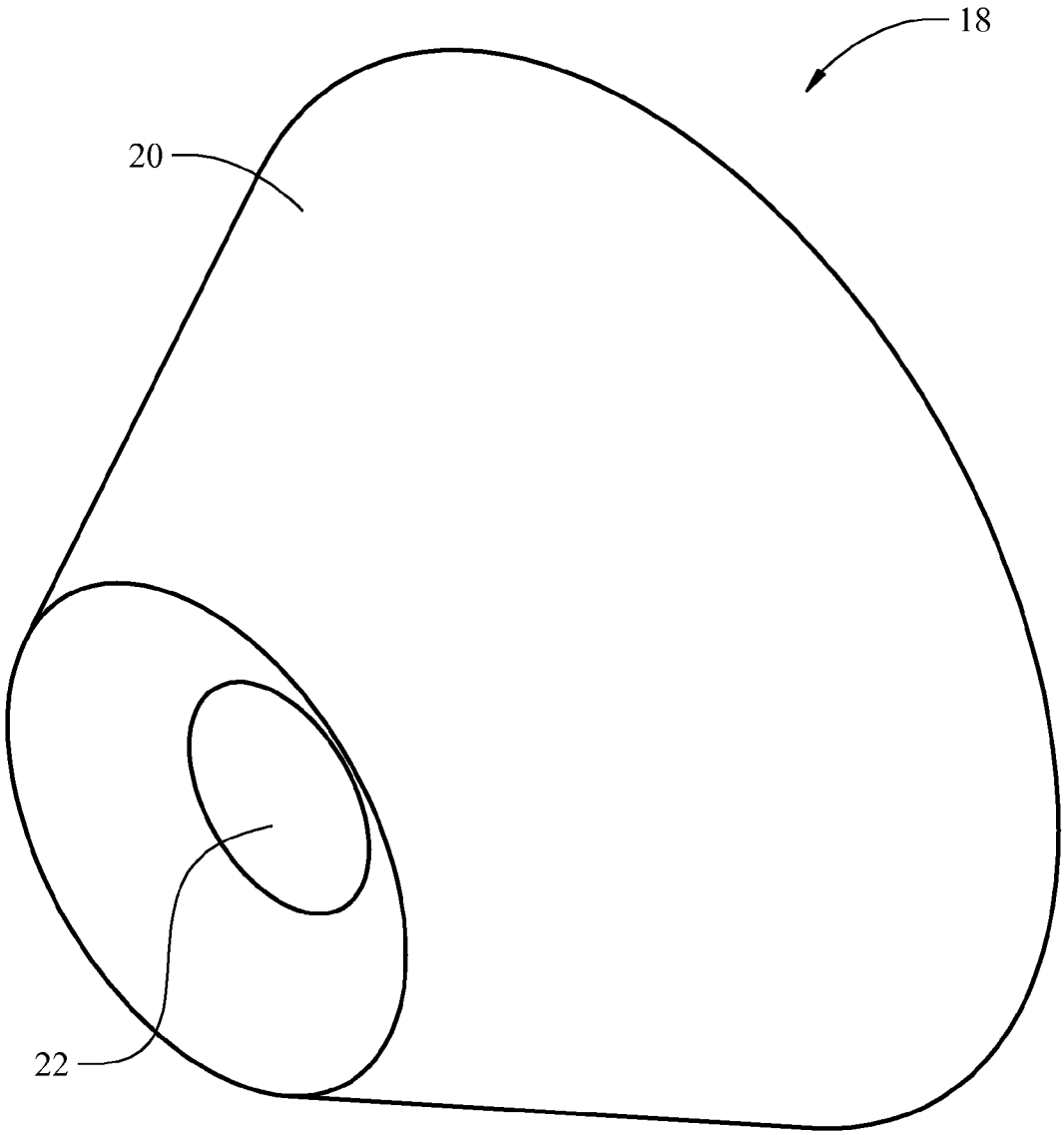
FIG. 6 is a perspective view of the lens shown in FIGS. 1, 2, and 5, in accordance with the first exemplary embodiment.
Figure 7:
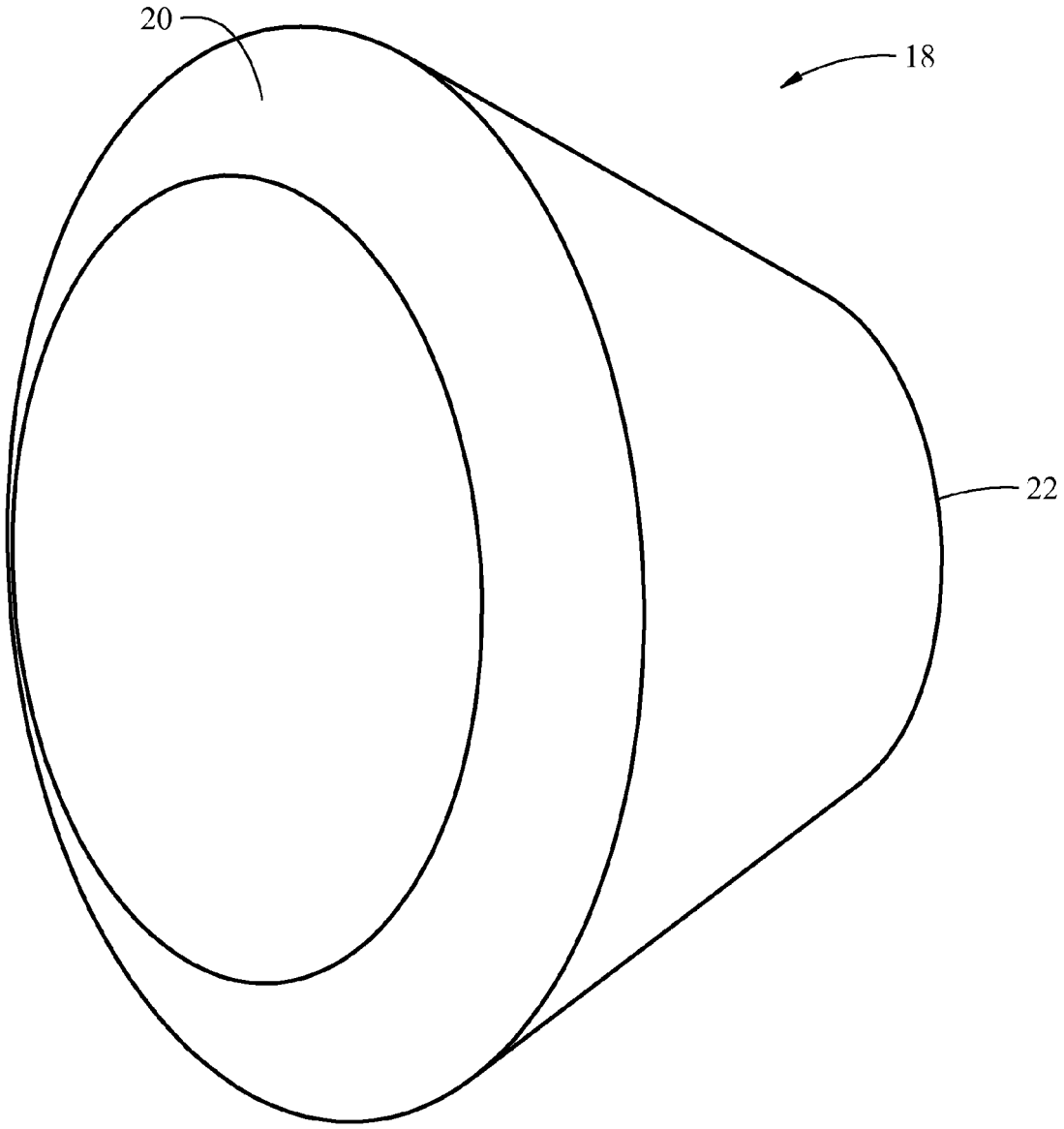
FIG. 7 is another perspective view of the lens shown in FIGS. 1, 2, 5, and 6, in accordance with the first exemplary embodiment.

FIG. 4 is a flowchart 200 illustrating a method for focusing antenna signal transmissions, in accordance with the first exemplary embodiment of the invention. It should be noted that any process descriptions or blocks in flow charts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

As is shown by block 202, a signal 14 is transmitted from the antenna feed 12. A portion of the signal 14 propagates through an interior portion 22 of a signal lens 18 (block 204). A portion of the signal 14 propagates through a periphery portion 20 of the signal lens 18 (block 206), wherein respective portions of the signal 14 propagates through the periphery portion 20 slower than through the interior portion 22. As the portion of the signal 14 propagating through the periphery portion 20 exits the signal lens 18, it combines in phase with a subsequent cycle of a portion of the signal 14 propagating through the interior portion 22 (block 208).

While the invention has been described as focusing signals 14 being transmitted from the antenna feed 12, the invention is equally applicable for focusing signals 14 received at the antenna feed 12.

The design disclosed herein may provide reduced material usage, which provides a more cost effective product compared to a microwave lens. The design does not employ traditional lens theory or the techniques used in zoned lenses. It is most applicable to lenses with directivities in the range of 12-25 dB. The resulting structures have focusing performance similar to a lens shaped like a common magnifying glass but with much less total material usage.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

The invention claimed is:

1. An antenna system comprising:

an antenna feed configured for communication with a signal having a wavelength; and a signal lens, the signal lens having a periphery portion that is thicker than an interior portion from a side of the signal lens adjacent the antenna feed to an opposing side of the signal lens, and being configured such that when the signal lens is impinged by the signal a portion of the signal propagating through the thicker periphery portion of the signal lens lags a portion of the signal propagating through the interior portion, which has a thickness less than a thickness of the periphery portion in a direction the respective portions of the signal propagate through the respective interior and periphery portion; a proximate opening and a distal opening formed in the interior portion, wherein the distal opening is larger than the proximate opening.

2. The antenna system of claim 1, wherein the signal lens comprises a material having a dielectric constant such that the periphery and interior portions of the signal lens have the same dielectric constant.

3. The antenna system of claim 2, wherein the signal lens comprises a material such that the signal will propagate through the material slower than the signal will propagate through air, and such that the portion of the signal will propagate through the material thickness of the periphery portion at about the same speed at which the portion of signal will propagate through the material thickness of the interior portion.

4. The antenna system of claim 1, further comprising an aperture formed in the interior portion.

5. The antenna system of claim 1, wherein the signal lens further comprises a segmented conical shape.

6. The antenna system of claim 1, wherein the signal lens focuses the signal.

7. The antenna system of claim 1, wherein the signal lens is configured such that it will take a longer time for the portion of the signal to propagate through the periphery portion than the time it will take for the portion of the signal to propagate through the interior portion.

8. The antenna system of claim 1, wherein the signal lens is configured such that the portion of the signal propagating through the periphery portion will still be propagating through the signal lens when the portion of the signal propagating through the interior portion has exited the signal lens.

9. The antenna system of claim 1, wherein the signal lens is operable for focusing signals being transmitted from the antenna feed and/or for focusing signals received at the antenna feed.

10. An antenna system comprising:

an antenna feed configured for communication with a signal having a wavelength;

a signal lens having a periphery portion that is thicker than an interior portion from a side of the signal lens adjacent the antenna feed to an opposing side of the signal lens; and an aperture formed in the interior portion;

wherein the thickness of the periphery portion relative to the interior portion is sized such that when the signal lens is impinged by the signal, a portion of the signal propagates approximately one less wavelength through the midsection of the interior portion than a portion of the signal propagates through the periphery portion; a proximate opening and a distal opening formed in the interior portion, wherein the distal opening is larger than the proximate opening.

11. An antenna system comprising:

an antenna feed configured for communication with a signal having a wavelength;

a signal lens having a periphery portion that is thicker than an interior portion from a side of the signal lens adjacent the antenna feed to an opposing side of the signal lens; and wherein the thickness of the periphery portion relative to the interior portion is sized such that when the signal lens is impinged by the signal, a portion of the signal traverses approximately one less wavelength through the midsection of the interior portion than a portion of the signal propagates through the periphery portion; a proximate opening and a distal opening formed in the interior portion, wherein the distal opening is larger than the proximate opening.

12. An antenna system comprising:

an antenna feed configured for communication with a signal having a wavelength;

a signal lens having a periphery portion that is thicker than an interior portion from a side of the signal lens adjacent the antenna feed to an opposing side of the signal lens, and comprising a material having a dielectric constant such that the interior and periphery portions of the signal lens have the same dielectric constant; and a proximate opening and a distal opening formed in the interior portion, wherein the distal opening is larger than the proximate opening, wherein the distal opening is approximately not more than three times the wavelength of the signal.

13. An antenna system comprising:

an antenna feed configured for communication with a signal having a wavelength;

a signal lens having a periphery portion that is thicker than an interior portion from a side of the signal lens adjacent the antenna feed to an opposing side of the signal lens; and a proximate opening and a distal opening formed in the interior portion, wherein the distal opening is larger than the proximate opening, wherein a radial width of the periphery portion is approximately $\lambda/(2n)$ and a thickness of the periphery portion is approximately $\lambda/(n-1)$.

14. An antenna system comprising:

an antenna feed configured for communication with a signal having a wavelength; and a signal lens having a periphery portion that is thicker than an interior portion from a side of the signal lens adjacent the antenna feed to an opposing side of the signal lens;

wherein the signal lens is configured such that when the signal lens is impinged by the signal, a portion of the signal propagates a multiple of approximately one less wavelength through the midsection of the interior portion than a portion of the signal propagates through the periphery portion; a proximate opening and a distal opening formed in the interior portion, wherein the distal opening is larger than the proximate opening.

15. A method of communicating using an antenna feed and a signal lens having a periphery portion that is thicker than an interior portion from a side of the signal lens adjacent the antenna feed to an opposing side of the signal lens, said method comprising the steps of:

transmitting a signal from the antenna feed;

propagating a portion of the signal through the interior portion of the signal lens; and propagating a portion of the signal through the periphery portion of the signal lens, the periphery portion having a thickness greater than a thickness of the interior portion in a direction the respective portions of the signal propagate through the respective periphery and interior portions, wherein the step of propagating through the interior portion; a proximate opening and a distal opening formed in the interior portion, wherein the distal opening is larger than the proximate opening is slower than the step of propagating through the interior portion.

16. The method of claim 15, wherein the signal is transmitted through the periphery portion approximately one phase slower than the interior portion.

17. The method of claim 15, wherein the signal lens comprises a material having a dielectric constant such that the periphery and interior portions of the signal lens have the same dielectric constant.

18. The method of claim 17, wherein the signal lens comprises a material that allows the signal to propagate therethrough slower than the signal will propagate through air, and wherein the portion of the signal propagates through the material thickness of the periphery portion at about the same speed at which the portion of signal propagates through the material thickness of the interior portion.

19. The method of claim 15, wherein the signal lens is approximately a conical segment.

20. The method of claim 15, wherein the antenna feed is a patch antenna.

21. The method of claim 15, further comprising combining in phase the portion of the signal propagating through the periphery portion of the signal lens with a subsequent cycle of the portion of the signal propagating through the interior portion of the signal lens.

22. The method of claim 15, wherein the step of propagating through the periphery portion takes a longer time than the time it takes for the step of propagating through the interior portion.

23. The method of claim 15, wherein the signal lens comprises a proximate opening and a distal opening formed in the interior portion, wherein the distal opening is larger than the proximate opening, wherein a radial width of the periphery portion is approximately $\lambda/(2n)$ and a thickness of the periphery portion is approximately $\lambda/(n-1)$.

24. A signal lens for focusing signals transmitted from and/or received at an antenna feed of an antenna system, the signal lens comprising a periphery portion that is thicker than an interior portion from a side of the signal lens configured to be adjacent an antenna feed to an opposing side of the signal lens, the interior and periphery portions formed from a material having a dielectric constant such that the interior and periphery portions of the signal lens have the same dielectric constant, and configured such that when the signal lens is impinged by a signal, a portion of the signal will take a longer time to propagate through the periphery portion than the time it will take a portion of the signal to propagate through the interior portion, whereby the portion of the signal propagating through the periphery portion will still be propagating through the signal lens when the portion of the signal propagating through the interior portion has exited the signal lens; a proximate opening and a distal opening formed in the interior portion, wherein the distal opening is larger than the proximate opening.

25. The signal lens of claim 24, wherein the periphery portion is thicker than the interior portion such that a thickness of the interior portion is less than a thickness of the periphery portion in a direction the respective portions of the signal propagate through the respective interior and periphery portions.

* * * * *